United States Patent [19]

Kastner

[11] Patent Number: 4,842,267

[45] Date of Patent: Jun. 27, 1989

[54] AMUSEMENT PARK DEVICE

[76] Inventor: Helmut Kastner, Goldene Aue 23, 2800 Bremen 41, Fed. Rep. of Germany

[21] Appl. No.: 188,276

[22] Filed: Apr. 29, 1988

Related U.S. Application Data

[63] Continuation-in-part of Ser. No. 931,737, Nov. 17, 1986, abandoned.

[30] Foreign Application Priority Data

Nov. 23, 1985 [DE] Fed. Rep. of Germany ..... 3541452

[51] Int. Cl.[4] ..... A63G 1/30

[52] U.S. Cl. ..... 272/28 S; 272/36

[58] Field of Search ..... 272/36, 33 R, 50, 51, 272/28

[56] References Cited

U.S. PATENT DOCUMENTS

| | | | |
|---|---|---|---|
| 1,896,175 | 2/1933 | Huffman | 272/36 X |
| 1,996,923 | 4/1935 | Jacobsen | 272/36 |
| 2,282,763 | 5/1942 | Kennedy | 272/36 |
| 2,357,481 | 9/1944 | Mallon | 272/36 X |
| 2,362,190 | 11/1944 | Cortes | 272/36 X |
| 2,456,648 | 12/1948 | Restall | 272/36 |
| 2,468,893 | 5/1949 | Orance | 272/36 |
| 2,547,152 | 4/1951 | Burg | 272/36 X |

FOREIGN PATENT DOCUMENTS

| | | | |
|---|---|---|---|
| 2921477 | 11/1980 | Fed. Rep. of Germany | 272/36 |

*Primary Examiner*—David A. Scherbel
*Assistant Examiner*—Richard E. Chilcot, Jr.
*Attorney, Agent, or Firm*—McGlew & Tuttle

[57] ABSTRACT

The invention relates to a device usable in an amusement park in association with a rotatable carousel having a support arm which supports a cylindrical bearing for a car which is used to accommodate one or more persons. The cylindrical bearing is held substantially vertically so that it defines a rotatable horizontal axis which rotatably supports the car. The car is suspended so that the center of gravity of the car holds in a position so that it accommodates the passengers in an upright position. Means are provided to bias the car into an upright position, but to permit it to rotate about its horizontal axis. A feature of the construction is that the car is provided with a control which may be manipulated by a passenger to orient wings of the device so that the device has a tendency to effect a roll about its horizontal axis. In addition it is provided with a similar control, or the same control which effects the driving rotation of the car about its central horizontal axis so that it begins a roll against the biasing action to which it is mounted. The ring mounting the car to the carousel support is constructed so that it may be centrally suspended from the support along with the front end thereof which permits the rotation about the horizontal axis.

12 Claims, 3 Drawing Sheets

FIG. 1
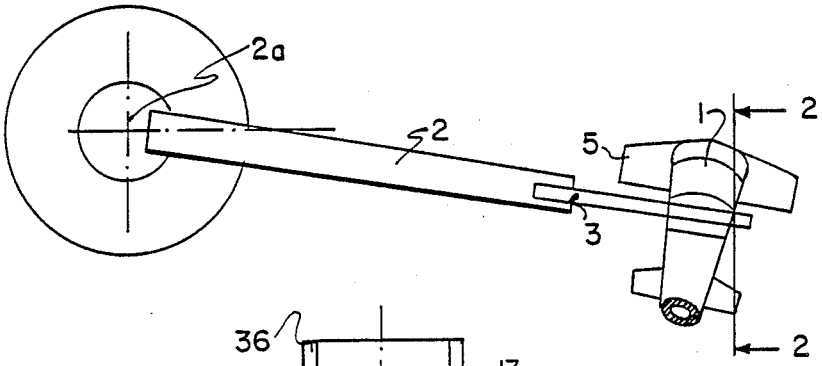
FIG. 6
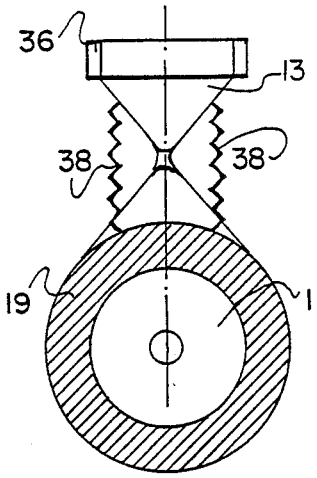
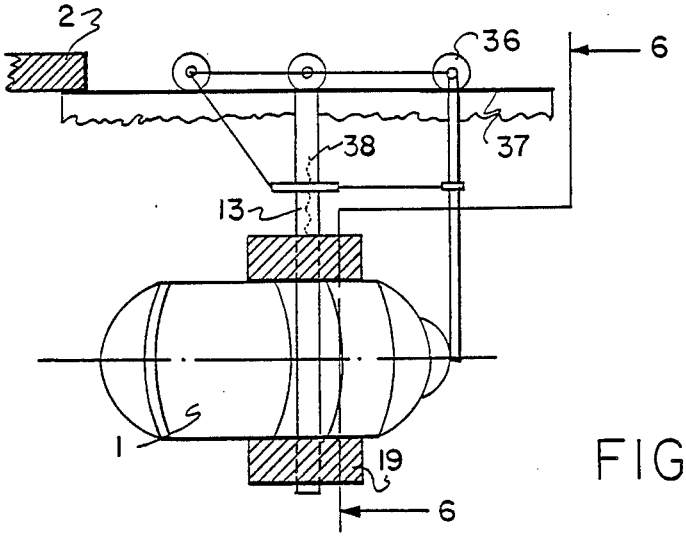
FIG. 2

AMUSEMENT PARK DEVICE

REFERENCE TO ANOTHER APPLICATION

This application is a continuation-in-part of application Ser. No. 931,737 filed Nov. 17, 1986, now abandoned and which was based on a German application No. P 35 41 452.9 filed in Germany on Nov. 23, 1985.

BACKGROUND OF THE INVENTION

FIELD OF THE INVENTION

This invention relates in general to an amusement park device and in particular to a new and useful amusement park device which comprises a car which is rotatably supported in a frame and which may be caused to rotate about an axis which is substantially a tangent to the movement axis of the car under the control of a rider and which includes means for moving the car back into a locked unrotated position.

The known amusement devices which operate with a carousel that rotates about a substantially vertical axis contain cars which either are stationarily held, or which may ride upwardly and downwardly, or even turn with respect to a vertical axis, or which even rotate about a horizontal axis when they are attached to a support which rotates about a horizontal axis. The present invention, on the other hand, provides a control which permits rotation of the car about a horizontal axis while it is carried around in a circle on a carousel. This permits the device to cause the car to act like it is rolling in the same manner as an aircraft would effect a roll.

Amusement park devices, or rides are known to be in the form of a carousel in which cars are pivotally mounted on a horizontal axis on arms that extend radially from a vertical central pillar. The cars are in the form of airplanes in order to emphasize visually the feeling of flying simulated in the carousel by its rotation around the central axis. The cars are made to rise by means of a frame with toggle lever arms that are in a bent position when the carousel is at a standstill and the cars are on the ground and before rotation begins are extended by means of a self-winding guide line, so that the cars are raised to a specific height or alternatively are merely raised by centrifugal force during rotation to a height proportional to the speed of rotation. In the process, the lock of the cars into starting position (zero position) is released, so that the riders in the car can influence the position of the car by means of control members that can adjust the flaps on the imitation wings. This makes it possible to execute upswings, downswings and rolling motions around the axis that lies in the direction of travel. Rolling over is prevented by a crank connected with the axis of rotation and attached to a guide line, which line will permit the crank to perform only pendulum motions even at the highest rotation speed of the carousel and is pulled taut by the lowering of the cars upon the slowing of the carousel and forces the cars back into starting position and finally locks them there.

German Pat. No. 1,958,404 discloses a carousel with cars that can pivot 360° around an axis (roll axis) that is tangential to the circle described by the car in its rotation around the central pillar and that also have movable imitation wings whose position can be altered by the riders themselves by means of control elements while they are in the car to simulate the motions of flight. This patent also discloses pivoting safety loops to hold a person securely in the car. Since the cars are suspended on pendulum arms in this carousel, the inertia of the car and its passengers is easier to overcome, so that the broader swinging motions are aimed for than with the carousel disclosed in the first-mentioned patent.

Amusement park rides with cars in suspension like those disclosed in the two above-mentioned patents, however, suffer from limiting defects at the feasible slow operating speeds and shortcomings that inhibit operation, so that a practical breakthrough in application has not been achieved to date.

SUMMARY OF THE INVENTION

The invention provides an amusement park device with cars whose rollover, and particularly whose roll-over around the axis lying in the direction of the forward motion of the car (roll axis) is controllable by force from the car.

Such a motorized drive mechanism between the car and the frame can be controlled in groups, individually or all at once from a central control post.

It is advantageous, however, to have the control of the drive mechanism in the hands of each rider, so that in a preferred embodiment a motorized drive mechanism is provided between each car and its frame that is directly coupled with the control elements in the car. Such a drive mechanism makes it possible, regardless of the speed at which the car is travelling, to institute pendulum-like rolling motions or a roll-over or several roll-overs one after the other, preferably around the roll axis, defined as an axis lying in the direction of forward travel of the car, but even around other axes that are at an angle with the roll axis. The rider thus can at his own discretion enhance or reduce the simulated feeling of flying. This substantially increases the attraction of such an amusement ride.

It is particularly advantageous that this drive mechanism between the car and its suspension frame and the control means for the drive of the movement mode of the car are completely independent. The design characteristics of the invention are thus applicable not only to carousels but also to amusement park rides with cars that perform another other type of motion, such as straight-line motion, rollercoaster motions or the like. The applications of the characteristics of the invention are also not limited to the visual imitation of airplanes or the like, but can be utilized with equal effectiveness in old-fashioned car designs and in futuristic imitations of flying objects. Nor should roll-over control around several axes at an angle to one another to be ruled out.

Particularly advantageous when applying the invention to carousel cars is a control gear that does not interfere with flight attitudes the car assumes as a result of centrifugal forces, so that the drive mechanism is active only if it is desired to move the car into flight attitudes that go beyond the attitudes created by physical forces. This means that the flight attitudes assumed as a result of centrifugal forces are not affected when the rider does not intend to do his own steering. For the purpose, in a further development of the invention, a transmission gear is provided between the control member in the car and the control element of an electric motor acting as a drive mechanism between the car and the frame, having two concentrically mounted parts capable of pivoting counter to one another, but spring-loaded counter to one another in both directions and a switch rod resting on both parts, whose length between the supports is adjustable. This means that the drive mechanism can only be switched on when it is intended that the car should perform rolling motions that go beyond the tilt caused by centrifugal forces. Similarly, by reversing the drive to counteract the effect of the centrifugal forces, one can induce a smaller tile so that one cannot only perform roll-overs in both directions, but also execute pendulum motions around a midposition. This transmission gear can also be designed so that at certain speeds, the drive of the car is switched off, when it is operated under the control of the rider to assume extreme attitudes.

The forcible inducement of roll-overs is possible only when the rider is securely held in the car and when this holding device is capable of fulfilling its safety function even in the event of malfunctions, in particular an unwanted stoppage of the ride.

According to a further aspect of the invention, an amusement park ride has seats inside the cars that are arranged in groups of three, wherein each of the two outer seats is associated with a swiveling safety hoop. These two safety hoops are connected on the sides respectively facing each other with a safety hoop for the seat in between them. This makes for better balancing of the car before the ride begins to operate. One rider alone can take the middle seat. Two riders take the two outer seats, while three riders sit next to one another in the car. The better weight distribution thereby achieved in dependence on the number of passengers in the car is particularly important in the execution of roll-overs, because uneven occupation of the car can result in imbalances that sometimes considerably take away from the roll-over sensation or may even inhibit the roll-over motion.

In a particularly suitable solution along these lines, the invention proposes that in the groups of three associated seats, the two outer seats in the car, in each case, be equipped with a swiveling safety hoops, both hoops having on their respective facing inner sides a half-hoop constituting part of the safety hoop for the middle seat. This yields a particularly handy design for the safety hoops that is also easy to operate and does not require too much weight in terms of material. Preferred are safety hoops that lie over the shoulders or the laps of the riders. To adjust to people of different sizes and to produce a safe and firm fit of the safety hoop to the bodies of the riders, compensating means are provided that comprises parts that can be telescopically slided counter to one another in opposition to the action of a spring and firmly joined to one another in a hold position. A design is proposed in which the safety hoop has an extension in the vicinity of its joint that can be drawn out of a pocket in the safety hoop counter to the action of a spring and is linked with a double lever, said double lever being mounted at one end with a joint on the car and having notches on its other end that engage separably from outside with opposing notches on the safety hoop. By designing this double lever as an angle lever whose leg bearing and notches runs roughly parallel to the end of the safety hoop in the direction of the spring tension acting on the articulated connection of the other end of the angle lever, the effect is achieved that the notches are pressed into one another when there is tensile stress on the spring. The desired release of the notches for purposes of opening the safety hoop is possible with conventional mechanical or electrical means when the car has come to a stop.

In accordance with the invention an amusement park device includes a support which defines a car axis with a frame on the support and a car which is intended to receive one or more riders suspended in the frame and rotatable around the axis. Individual control elements are arranged in each car which are operable by a rider for instituting the rotary motion during the forward travel of the car. The rotary motion may be caused by a wind effect and in addition by drive means responsible to the control to cause rotation of the car. The construction includes means associated with the car which is independent of the control which forces the car from a rotated position into locked starting position. The drive means for rotating the car includes a motorized drive between the frame and the car.

Accordingly, it is an object of the invention to provide an improved amusement park device which includes a car which may be rotated and which will be controlled to be rotated back to a non-rotated position and which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a top planar view of a carousel having an amusement park device constructed in accordance with the invention;

FIG. 2 is a section taken along the line 2—2 of FIG. 1;

FIG. 6 is a section taken along the line 6—6 of FIG. 2.

DESCRIPTION OF THE PREFERRED EMBODIMENTS

Figure 3:
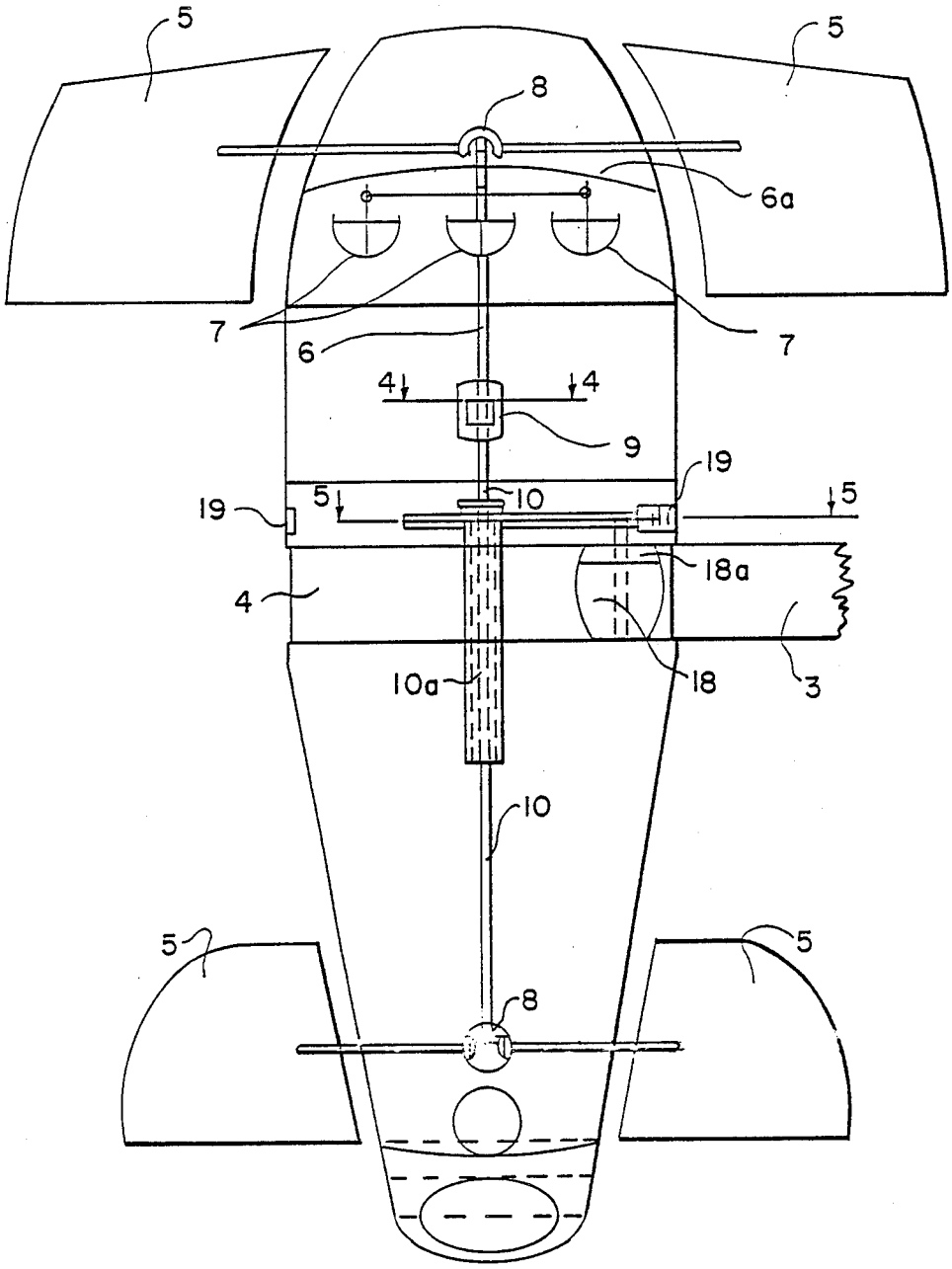
FIG. 3 is a schematic top view of the device of FIG. 1 in the shape of an airplane and on a larger scale than that used in FIG. 1.

Referring to the drawings in particular, the invention embodied therein comprises an amusement park device which includes a carousel or support frame 2 which may, for example, be part of a carousel or rotating device which rotates about a substantially vertical axis 2*a*. The frame 2 carries a support 3 to which is affixed a support ring 19 which mounts the device so that it is rotatable about a horizontal axis under the influence of a control member in the car which is operable by a rider such as the control 7 shown in FIG. 3. The control is provided for instituting the rotary motion around the horizontal axis during the rotational travel of the car on the carousel frame 2, and in response to the control to cause rotary motion of the car. Means are associated with the car in the frame such as the mechanism indicated in FIGS. 3, 4 and 5 for forcing or biasing the car back from a rotary position into a locked starting position. The drives means for the drive mechanism which is operated by the control 7 includes either a motorized drive in the form of an electric motor 18 driving through a gear drive to cause the rotary motion of the car in either direction, or the effect of the wind caused when the control is actuated to turn rear wings 5 in respective opposite directions.

The device 1 is designed as a futuristic shape or space vehicle or, e.g. as an airplane or jet plane. In these embodiments, the cars are mounted rotatably around an axis lying in the direction of forward travel, i.e., in the case of these embodiments around an axis tangential to the circle described by the car as it travels around, at the free ends of extension arms 3 in a bearing 19 having a substantially horizontal rotation axis. The bearing 19 is placed as much as possible at the enter of gravity of an occupied device 1 in order to seat it in as balanced a fashion as possible so that in the rest phase it will right itself thanks to an appropriately designed gravity reaction and the effect of a biased mounting. The center of gravity of the car in its occupied and unoccupied states should lie as much as possible under the bearing 19, so that the car will right itself from any inclined position. The airplane schematically suggested in FIG. 2 is repeated schematically in FIG. 3 on a larger scale with a transmission 9 shown displaced axially from its actual location in the same plane of the bearing 19, for clarity. On the outside of its rear end are wings 5 capable of turning in opposite direction to each other.

Control shafts 6 are connected with passenger operable control levers 7 inside the car, so that the rider can cause the wings 5 to shift by rotating shaft 6 and control elements **6*a* through bevel gear ring 8. In the running wind of the turning carousel, windmill effects can be obtained that result in lateral tilting or rolling of the device 1** and this rolling can be reversed alternately at will by turning the wings in an opposite direction.

Between the device 1 and the support arm 3, every device is provided with a motorized rotation drive supplied by an electric motor 18. The revolutions of this motor 18 are stationarily mounted on the frame of the device. The rotation is transmitted to a ring 19, such as a gear ring (in FIG. 3 shown partially cutaway) extend around at least a portion of the interior of the device 1, so that a motor 18 can drive a pinion engaged with the gear ring 19 to rotate the car around its horizontal or longitudinal axis (roll axis) by force. The regulating element of the electric motor 18 can, again, be actuated by the rider in the car by means of a control member 7. A transmission gear 9, positioned in between the control member 7 and a regulating element **18*a* of the drive motor 18**, compensates for centrifugal forces.

Figure 4:
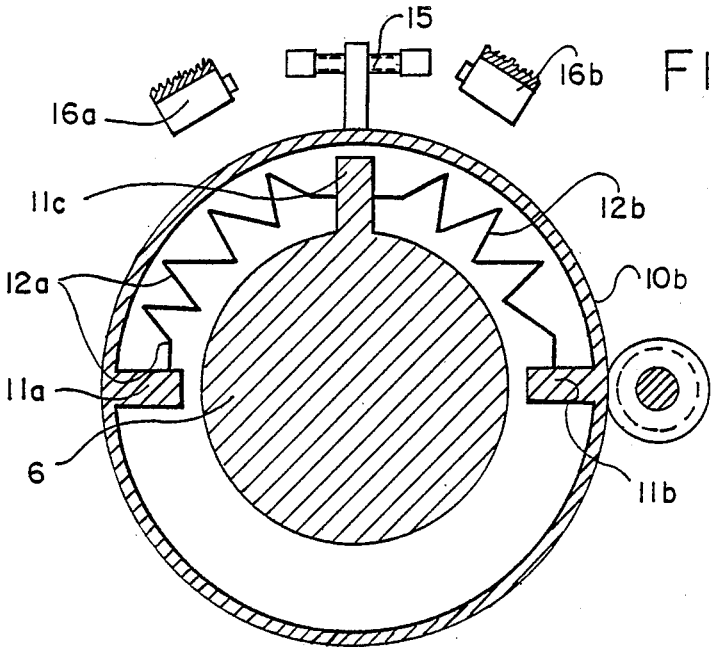
FIG. 4 is an enlarged cross-section on a larger scale taken along line 4—4 of FIG. 3.
Figure 5:
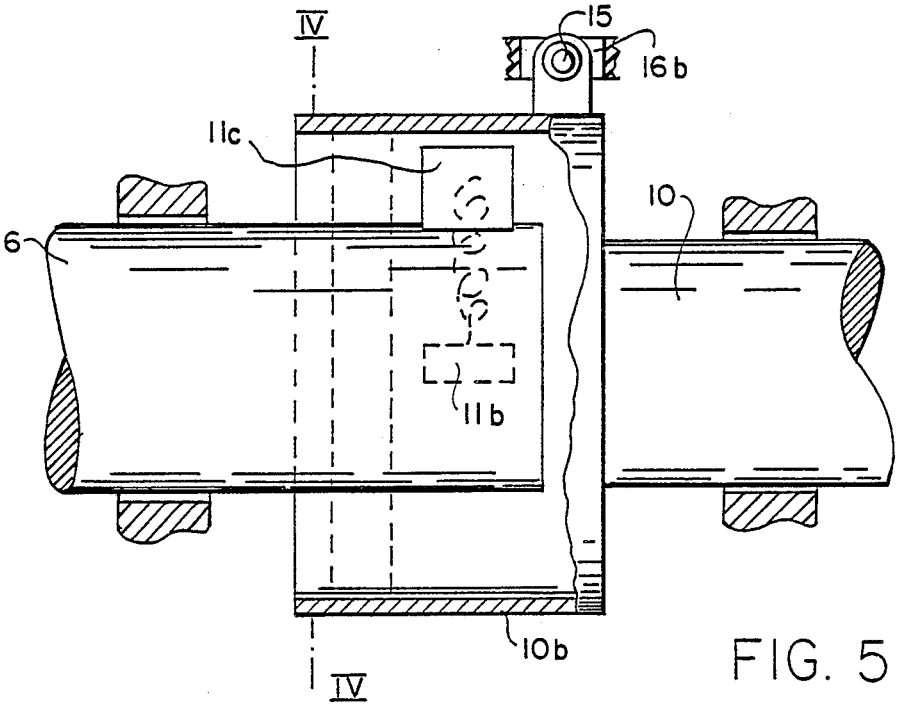
FIG. 5 is an enlarged axial sectional view of the control shafts for rotating the device taken along the line 5—5 of FIG. 3.

As seen in FIG. 4 the transmission gear 9 has a control shaft 6 and a servo drive shaft 10 mounted concentrically to the former with two cams **11*a* and 11*b* mounted thereon that are at an angle to one another and interact through restoring or biasing springs with opposing surfaces on a projection 11*c* of the shaft 6. Between the cams 11 and the opposing surfaces in each case are placed springs 12*a* and 12*b*, so that relative movements between the shafts 6 and 10 are possible by overcoming the spring forces. This facilitates displacements of the device 1 as a consequence of centrifugal forces without being controlled only by the desires of the rider so that the rider, can only induce movements that exceed those device movements that are determined by centrifugal force. The springs 12** also insure a smooth transition when the control movements of the rider are transmitted to the regulating elements of the motor.

A switch rod 15 is supported on a jacket **10*b* on one end of the shaft 10 and activates control switches 16*a* and 16*b* of the car for the regulating elements 18*a* of the electric motor 18 to limit the movement of the device 1 beyond a predetermined rotation. For fine adjustment, the switch rod 15 is adjustable in terms of its length between two supports 15*a* and 15*b***.

In FIGS. 2 and 6 an embodiment of a device car of a kind that can be used when the characteristics of the invention are to be utilized in an amusement park ride in which the cars travel through essentially non-uniform stretches, and move, for example, along flat segments or in a rollercoaster-type motion. In this embodiment, a car 1 is suspended on the frame 13 and enclosed by a ring 19, on which the drive motor 18 is mounted to effect rotation of the car about its longitudinal axis. The frame 3 is, in this case, suspended for movement by means of running gear 36 on elevated tracks 37 carried on the carousel which tracks are attached to and form extensions of arms of frame. The car 1, together with the frame 13, can make reciprocal linear movement radially of the center axis of rotation of the carousel, thus permitting simultaneous rotational movement of the car about the carousel center axis, about its own longitudinal axis and linear radial movement. The pendulum effect and swing-out of the car 1 to the sides can be elastically (shown in FIG. 6 only) 1 and the running gear 36 so that the pendulum effect, desirable as such, can be suitably stabilized and restricted by the springs.

While specific embodiments of the invention have been shown and described in detail to illustrate the application of the principles of the invention, it will be understood that the invention may be embodied otherwise without departing from such principles.

What is claimed is:

1. An amusement device comprising:

a carousel rotatable about a vertical axis;

a support arm carried by said carousel;

a vertically arranged rotational supporting ring carried by said support arm and having a substantially horizontal device rotational axis;

a device car having a least one passenger receiving place and supported in said ring with the rotational axis extending in a forward orientation of the device car and being rotational therein about the device rotational axis of said ring;

passenger operable control means comprising a drive motor;

an internal gear carried by said device car;

the drive motor having a gear meshing with said internal gear;

means connected between said control means and said drive motor for driving said drive motor to rotate said gear with said car about said device rotational axis in the direction of rotation of the carousel independently of the movement of the carousel;

at least one pair of air foil flaps pivotally mounted on said device car;

the control being connected to said flaps to rotate said flaps to initiate rotation of said device car;

said means connected between said control means and said drive motor device car having a central shaft portion having a radial projection, a hollow shaft portion extending around said central shaft portion, said hollow shaft portion having diametrically opposite projections thereon and a spring extending between each radial projection of said hollow shaft portion and the projection of said shaft portion, one of said shaft portion and said hollow shaft portion being attached to said device car and being urged by said springs into a rotationally starting position.

2. An amusement park device for a carousel which rotates about a vertical axis comprising a support frame carried on the carousel and defining a bearing for permitting rotation about a horizontal axis, a car intended to receive a rider suspended in said bearing and being rotatable around the horizontal axis from a rotationally neutral, rider receiving starting position, an individual control in said car operable by a rider for instituting the rotary motion around said axis during the forward travel of said car with said support frame, drive means connected to said control and responsive to said control to cause rotation of said car comprising a motorized drive mechanism provided between said frame and said car, and means associated with said car and said frame acting independently of said control for forcing said car into the starting position.

3. An amusement park device according to claim 2, wherein said motorized drive between each car in said frame includes a hand control in each car which is regulated by the rider.

4. An amusement park device according to claim 3, wherein between said control and said hand regulating element there is provided a transmission gear constructed to compensate for centrifugal force influence.

5. An amusement park device according to claim 4, wherein between each car and its associated frame there is an electrical motorized drive capable of reversing the direction of rotation.

6. An amusement device, comprising a carousel rotatable about a vertical axis, a support arm carried by said carousel, a vertically arranged rotational supporting ring carried by said support arm and having a substantially horizontal device rotational axis, a device car having a least one passenger receiving place and being supported in said ring with the rotational axis extending in a forward orientation of the device car and being rotational therein about the device rotational axis of said ring and passenger operable control means comprising a drive motor acting on said device car to cause rotation of said device car about the horizontal axis in the direction of rotation of the carousel independently of the movement of the carousel.

7. An amusement device according to claim 6, wherein said passenger operable means further comprises a wind deflection device carried by said device car for deflecting said device car so that it rotates about said device axis.

8. An amusement device according to claim 6, wherein said device simulates an airplane and a passenger operable means further includes air foil elements arranged on each side of said device car and causing deflection of said car so that it rotates about said device axis.

9. An amusement device according to claim 6, in which said control includes a gear ring disposed in said device car and extending around at least a portion thereof, the drive motor having a gear meshing with the gear ring to effect rotation thereof about the horizontal axis thereby to rotate said device car.

10. An amusement device according to claim 6, including means biasing said device car to a rotational neutral, starting position.

11. An amusement device according to claim 10, wherein said device car has a central shaft portion having a radial projection, a hollow shaft portion extending around said shaft portion, said hollow shaft portion having diametrically opposite projections thereon and a spring extending between each radial projection of said hollow shaft portion and the projection of said shaft portion, one of said shaft portion and said hollow shaft portion being attached to said device car and being urged by said springs into a rotationally neutral position.

12. An amusement device according to claim 6, including at least one pair of air foil flaps pivotally mounted on said device car, the control being connected to said flaps to rotate said flaps to initiate rotation of said device car, an internal gear carried by said device car, the drive motor having a gear meshing with said internal gear and means connected between said control and said drive motor for driving said drive motor to rotate said gear with said car about said device rotational axis.

* * * * *